US008040258B2

(12) United States Patent
Ibrahim et al.

(10) Patent No.: US 8,040,258 B2
(45) Date of Patent: Oct. 18, 2011

(54) ENHANCED SITUATIONAL AWARENESS SYSTEM AND METHOD

(75) Inventors: Mohammed Ibrahim, Karnataka (IN); Dinesh Ramegowda, Karnataka (IN)

(73) Assignee: Honeywell International Inc., Morristown, NJ (US)

( * ) Notice: Subject to any disclaimer, the term of this patent is extended or adjusted under 35 U.S.C. 154(b) by 373 days.

(21) Appl. No.: 12/419,849

(22) Filed: Apr. 7, 2009

(65) Prior Publication Data

US 2010/0253546 A1 Oct. 7, 2010

(51) Int. Cl.
*G08G 5/04* (2006.01)

(52) U.S. Cl. ..... 340/961; 340/963; 340/971; 340/973; 342/29; 701/301

(58) Field of Classification Search ..... 340/961, 340/963, 971, 973; 342/29, 30; 701/9, 14, 701/300, 301

See application file for complete search history.

(56) References Cited

U.S. PATENT DOCUMENTS

| | | | | |
|---|---|---|---|---|
| 4,918,442 | A | 4/1990 | Bogart | |
| 5,179,377 | A | 1/1993 | Hancock | |
| 5,296,854 | A | 3/1994 | Hamilton et al. | |
| 6,064,335 | A | 5/2000 | Eschenbach | |
| 6,512,975 | B2 * | 1/2003 | Watson | 701/120 |
| 6,683,541 | B2 | 1/2004 | Staggs et al. | |
| 6,694,249 | B1 | 2/2004 | Anderson et al. | |
| 6,911,936 | B2 * | 6/2005 | Stayton et al. | 342/182 |
| 7,030,780 | B2 | 4/2006 | Shiomi et al. | |
| 7,414,567 | B2 * | 8/2008 | Zhang et al. | 342/29 |
| 2001/0048763 | A1 | 12/2001 | Takatsuka et al. | |
| 2004/0095259 | A1 | 5/2004 | Watson | |
| 2005/0232512 | A1 | 10/2005 | Luk et al. | |
| 2007/0001874 | A1 | 1/2007 | Feyereisen et al. | |

FOREIGN PATENT DOCUMENTS

| | | | |
|---|---|---|---|
| EP | 1950532 | A2 | 7/2008 |
| WO | 2009010969 | A2 | 1/2009 |

OTHER PUBLICATIONS

Uijtdehaag, M.; Thomas, R.; Rankin, J.R.; 3-Dimensional Cockpit Display with Traffic and Terrain Information for the Small Aircraft Transportation System, NASA Glenn Research Center, Ohio University, Mar. 2004.

Doehler, H.U.; Hecker, P.; Rodloff, R.; Image Data Fusion for Future Enhanced Vision Systems, Institute of Flight Guidance, German Aerospace Center, DLR, Feb. 1999.

EP Search Report, EP 10156563.8-1232/2239719 dated Apr. 20, 2011.

* cited by examiner

*Primary Examiner* — Hung T. Nguyen

(74) *Attorney, Agent, or Firm* — Ingrassia Fisher & Lorenz, P.C.

(57) ABSTRACT

Methods and apparatus are provided for enhancing the situational awareness of an operator. Automatic dependent surveillance-broadcast (ADS-B) traffic data transmitted by a traffic entity are received. The ADS-B traffic data are processed to determine traffic entity position. The traffic entity position is mapped to corresponding image coordinates on an enhanced vision system (EVS) display. A region of interest around at least a portion of the corresponding image coordinates is selected. An actual image of the traffic entity is rendered on the EVS display, at the corresponding image coordinates, and with at least a portion of the region of interest being highlighted.

20 Claims, 4 Drawing Sheets

ENHANCED SITUATIONAL AWARENESS SYSTEM AND METHOD

TECHNICAL FIELD

The present invention generally relates to situational awareness, and more particularly relates to a system and method of providing enhanced situational awareness to an operator, either within a vehicle or a centralized control station.

BACKGROUND

Air travel has long been, and continues to be, a safe mode of transportation. Nonetheless, substantial effort continues to be expended to develop flight systems and human-factors practices that even further improve aircraft flight safety. Some examples of these flight systems include flight management systems, global navigation satellite systems, differential global positioning systems, air data computers, instrument landing systems, satellite landing systems, traffic alert and collision avoidance systems, weather avoidance systems, thrust management systems, flight control surface systems, and flight control computers, just to name a few.

Despite good flight system design and improved human-factors practices, there is a continuous desire to provide further flight safety improvements. One particular aspect that is presently undergoing significant improvement is in the area of obstacle avoidance. It is generally understood that improving aircraft flight crew situational awareness during flight operations, ground operations, and landing operations, will likely improve the ability of a flight crew to avoid obstacles.

During flight operations, flight crews make every effort to consistently survey the region around the aircraft. However, aircraft structures, such as the wings and the aft lower fuselage, may block large regions of airspace from view. Moreover, at times the cockpit workload can possibly detract the flight crew from visual scanning. To enhance situational awareness during crowded air traffic and/or low visibility flight operations, many aircraft are equipped with a Traffic Alert and Collision Avoidance System (TCAS). Although the TCAS does provide significant improvements to situational awareness, the burden remains on the pilots of TCAS-equipped aircraft to avoid another aircraft.

During ground operations, the possibility for a runway incursion exists, especially at relatively large and complex airports. Governmental regulatory bodies suggest that most runway incursions that have occurred are due to pilot induced errors. These regulatory bodies also suggest that the likelihood of a runway incursion increases if a pilot lacks awareness on the position and intention of other traffic in the vicinity of the aircraft.

Regarding landing operations, there is presently no method or device that provides a visual display of another aircraft encroaching on the flight path of the host aircraft during simultaneous approach on parallel runways. Although the Instrument Landing System (ILS) does provide lateral, along-course, and vertical guidance to aircraft that are attempting to land, the ILS may not maintain adequate separation during a simultaneous approach on parallel runways because the displayed localizer signal during an ILS approach does not support independent parallel approaches. Although parallel approaches may be adequately staggered in fair weather, and the ILS is intended to maintain an adequate vertical separation between aircraft until an approach is established, inclement weather may decrease airport capacity and compound the potential parallel approach problem.

Hence, there is a need for a system and method of improving aircraft flight crew situational awareness during flight operations, ground operations, and landing operations that does not suffer the drawbacks of presently known systems. The present invention addresses at least this need.

BRIEF SUMMARY

In one embodiment, and by way of example only, a method of providing enhanced situational awareness to an operator includes receiving automatic dependent surveillance-broadcast (ADS-B) traffic data transmitted by a traffic entity. The ADS-B traffic data are processed to determine traffic entity position. The traffic entity position is mapped to corresponding image coordinates on an enhanced vision system (EVS) display. A region of interest around at least a portion of the corresponding image coordinates is selected. An actual image of the traffic entity is rendered on the EVS display, at the corresponding image coordinates, and with at least a portion of the region of interest being highlighted.

In another exemplary embodiment, a system for providing enhanced situational awareness to an operator includes an enhanced vision system (EVS) display and a processor. The EVS display is coupled to receive image rendering display commands and is operable, in response thereto, to render images. The processor is in operable communication with the EVS display. The processor is adapted to receive automatic dependent surveillance-broadcast (ADS-B) traffic data associated with a traffic entity and image data representative of the traffic entity and is operable, in response to these data, to determine traffic entity position, map the traffic entity position to corresponding image coordinates on the EVS display, select a region of interest around at least a portion of the corresponding image coordinates, and supply image rendering display commands to the EVS display that cause the EVS display to render an actual image of the traffic entity, at the corresponding image coordinates, and with at least a portion of the region of interest being highlighted.

In still another exemplary embodiment, a system for providing enhanced situational awareness to an operator includes a plurality of enhanced vision system (EVS) image sensors, an EVS display, and a processor. Each EVS image sensor is operable to sense one or more target entities within a predetermined range and supply image data representative thereof. The EVS display is coupled to receive image rendering display commands and is operable, in response thereto, to render images. The processor in is operable communication with the EVS display and the EVS sensors, the processor is adapted to receive automatic dependent surveillance-broadcast (ADS-B) traffic data associated with a traffic entity and image data from one or more of the EVS image sensors. The processor is operable, in response to the received data, to determine a position of each of the traffic entities, compute a threat level of each of the traffic entities, assign a priority level to each of the traffic entities based on the computed threat levels, select one of the plurality of EVS image sensors from which to receive image data based at least in part on the priority level of each of the traffic entities, map each traffic entity position to corresponding image coordinates on the EVS display, select a region of interest around at least a portion of each of the corresponding image coordinates, and supply image rendering display commands to the EVS display that cause the EVS display to render actual images of selected ones of the traffic entities, at the corresponding image coordinates, and with at least a portion of each region of interest being highlighted.

Furthermore, other desirable features and characteristics of the enhanced situational awareness system and method will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. Furthermore, there is no intention to be bound by any theory presented in the preceding background or the following detailed description.

Figure 1:
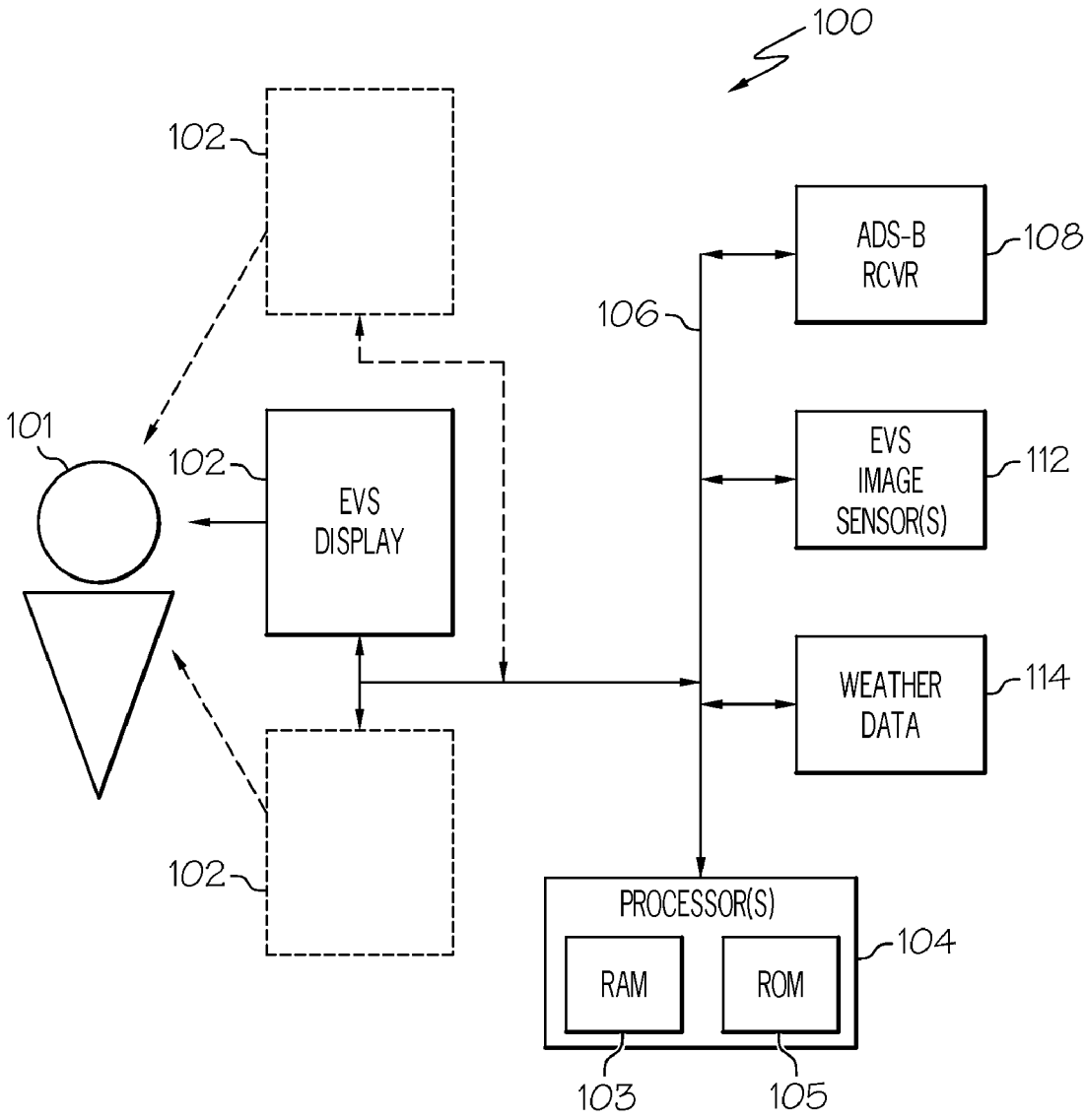
FIG. 1 depicts a functional block diagram of an exemplary enhanced situational awareness system.

Turning first to FIG. 1, a functional block diagram of an exemplary enhanced situational awareness system 100 is depicted, and includes an enhanced vision system (EVS) display 102 and a processor 104. The EVS display 102 is used to render various images and data, in both a graphical and a textual format, and to supply visual feedback to a user 101. In particular, the EVS display 102, in response to image rendering display commands received from the processor 104, renders enhanced images of the flight environment to the user 101, especially during low visibility conditions. A description of some exemplary preferred images that are rendered on the EVS display 102 will be provided further below.

It will be appreciated that the EVS display 102 may be implemented using any one of numerous known displays suitable for rendering image and/or text data in a format viewable by the user 101. Non-limiting examples of such displays include various cathode ray tube (CRT) displays, and various flat panel displays such as various types of LCD (liquid crystal display) and TFT (thin film transistor) displays. The EVS display 102 may be implemented as a panel mounted display, a HUD projection, or any one of numerous other display technologies now known or developed in the future. The EVS display 102 may additionally be implemented as a stand-alone, dedicated display, or be implemented as part of an existing flight deck display, such as a primary flight display (PFD) or a multi-function display (MFD), just to name a few. As FIG. 1 also depicts in phantom, the system 100 may be implemented with a plurality of EVS displays 102, if needed or desired.

The processor 104 is in operable communication with the EVS display 102 and a plurality of data sources via, for example, a communication bus 106. The processor 104 is coupled to receive data from the data sources and is operable, in response to the received data, to supply appropriate image rendering display commands to the EVS display 102 that causes the EVS display 102 to render various images. The data sources that supply data to the processor 104 may vary, but in the depicted embodiment these data sources include at least an automatic dependent surveillance-broadcast (ADS-B) receiver 108, one or more EVS image sensors 112, and a weather data source 114. Moreover, though not depicted in FIG. 1, it will be appreciated that the processor 104 may be coupled to receive various data from one or more other external systems. For example, the processor 104 may also be in operable communication with a terrain avoidance and warning system (TAWS), a traffic and collision avoidance system (TCAS), an instrument landing system (ILS), and a runway awareness and advisory system (RAAS), just to name a few. If the processor 104 is in operable communication with one or more of these external systems, it will be appreciated that the processor 104 is additionally configured to supply appropriate image rendering display commands to the EVS display 102 (or other non-illustrated display) so that appropriate images associated with these external systems may also be selectively displayed on the EVS display 102.

The processor 104 may include one or more microprocessors, each of which may be any one of numerous known general-purpose microprocessors or application specific processors that operate in response to program instructions. In the depicted embodiment, the processor 104 includes on-board RAM (random access memory) 103 and on-board ROM (read only memory) 105. The program instructions that control the processor 104 may be stored in either or both the RAM 103 and the ROM 105. For example, the operating system software may be stored in the ROM 105, whereas various operating mode software routines and various operational parameters may be stored in the RAM 103. It will be appreciated that this is merely exemplary of one scheme for storing operating system software and software routines, and that various other storage schemes may be implemented. It will also be appreciated that the processor 104 may be implemented using various other circuits, not just one or more programmable processors. For example, digital logic circuits and analog signal processing circuits could also be used.

The ADS-B receiver 108 is configured to receive ADS-B transmissions from one or more external traffic entities (e.g., other aircraft) and supplies ADS-B traffic data to the processor 104. As is generally known, ADS-B is a cooperative surveillance technique for air traffic control and related applications. More specifically, each ADS-B equipped aircraft automatically and periodically transmits its state vector, preferably via a digital datalink. An aircraft state vector typically includes its position, airspeed, altitude, intent (e.g., whether the aircraft is turning, climbing, or descending), aircraft type, and flight number. Each ADS-B receiver, such as the ADS-B receiver 108 in the depicted system 100, that is within the broadcast range of an ADS-B transmission, processes the ADS-B transmission and supplies ADS-B traffic data to one or more other devices. In the depicted embodiment, and as was just mentioned, these traffic data are supplied to the processor 104 for additional processing. This additional processing will be described in more detail further below.

The EVS image sensor 112 is operable to sense at least one or more target entities within a predetermined range and supply image data representative of each of the sensed target entities. The image data are supplied to the processor 104 for further processing, which will also be described further below. The EVS image sensor 112 may be implemented using any one of numerous suitable image sensors now known or developed in the future. Some non-limiting examples of presently known EVS image sensors 112 include various long-wave infrared (LWIR) cameras, medium wave infrared (MWIR) cameras, short-wave infrared (SWIR) cameras, electro-optical (EO) cameras, line scan cameras, radar devices, lidar devices, and visible-band cameras, just to name a few.

No matter the particular type of EVS sensor 112 that is used, it is noted that each EVS sensor type exhibits varied capabilities of range, resolution, and other characteristics. As such, in a particular preferred embodiment, the system 100 preferably includes a plurality of EVS sensors 112 of varying capability. Moreover, in the context of an aircraft environment, the EVS sensors 112 are preferably mounted on the outer surface of the aircraft, and are strategically located, either together or at various locations on the aircraft, to optimize performance, design, and cost. As will be described further below, when a plurality of EVS image sensors 112 are included, the processor 104 implements a process to select one or more of the EVS image sensors 112 from which to receive image data for further processing.

The weather data source 114, as the nomenclature connotes, supplies data representative of environmental weather conditions. Preferably, the weather data used by the processor 104 in the depicted system is representative of the environmental weather conditions that are within a predetermined range of the aircraft within which the system 100 is installed. For example, within the range of the EVS sensor 112 having the maximum range. It will be appreciated, of course, that this may vary. Nonetheless, as will be described further below, the processor 104, at least in some embodiments, uses the weather data as part of the process to select one or more of the EVS sensors 112 from which to receive image data for further processing. Moreover, in some embodiments, the system 100 could be implemented without the weather data source 114.

The system 100 described above and depicted in FIG. 1 provides enhanced situational awareness to the user 101. To do so, the system implements a process whereby actual images of one or more traffic entities may be rendered on one or more EVS displays 102 in a manner in which the one or more traffic entities are clearly and adequately highlighted to the operator 109. An exemplary process 200 implemented by the system 100 is depicted in flowchart form in FIG. 2, and with reference thereto will now be described in more detail. Before doing so, however, it is noted that parenthetical reference numerals in the following descriptions refer to like-numbered flowchart blocks in FIG. 2.

The process 200 begins upon receipt, by the processor 104, of ADS-B traffic data supplied from the ADS-B receiver 108 (202). The processor 104 processes the received ADS-B traffic data to determine, among other things, the position of each traffic entity associated with the received ADS-B traffic data (204). The processor 104 then maps the position of the traffic entity to corresponding image coordinates on EVS display 102 (208), and selects a region of interest around at least a portion of the corresponding image coordinates (212). Thereafter, the processor 104 supplies image rendering display commands to the EVS display 102 that causes the EVS display 102 to render an actual image of the traffic entity, at the corresponding image coordinates, and with at least a portion of the region of interest being highlighted (214).

It will be appreciated that the system 100 could implement the process 200 for each and every target entity from which ADS-B traffic data are received. However, in a particular preferred embodiment, the system 100 is configured to implement the entire process 200 for only selected traffic entities. In particular, for only traffic entities that are considered to present a suitably high threat. For example, some traffic entities may be static (e.g., not presently moving) entities, or may be moving away from the aircraft in which the system 100 is installed. In both of these exemplary instances, the traffic entity (or entities) that made the ADS-B transmission, while within range, may or may not be assessed as viable potential threats and/or may or may not be classified as threats of sufficiently high priority.

Figure 2:
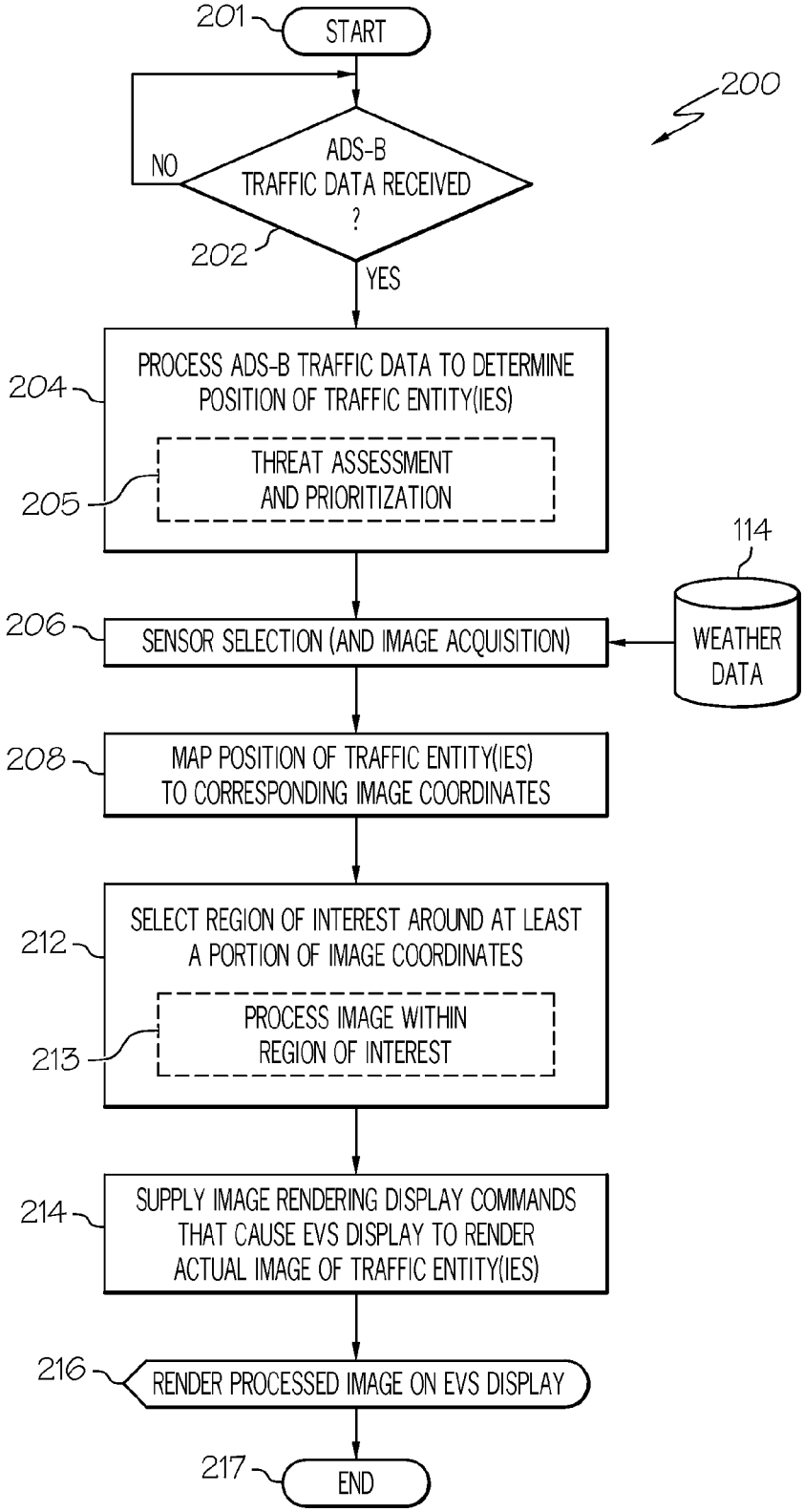
FIG. 2 depicts an exemplary process, in flowchart form, that may be implemented by the system of FIG. 1.

In view of the foregoing, and as FIG. 2 further depicts, the processor 104, in some embodiments, may also assess the threat level of each of the traffic entities from which ADS-B data was received, and assign a priority level to each of the traffic entities based on the determined assessed threat determination. To do so, the processor 104 preferably implements any one of numerous known threat assessment and prioritization algorithms (205). For example, the previously mentioned TCAS implements a suitable threat prioritization algorithms. The priority levels that are assigned to traffic entities may vary in number in type. One suitable paradigm is to assign each traffic entity one of two priority levels, either a high priority or a low priority.

It was noted above that the system 100 is preferably implemented with a plurality of EVS image sensors 112 of varying capability. This, in part, is because no single EVS image sensor 112 may exhibit suitable capabilities under all weather conditions. In addition, in most embodiments the computational resources of the system 100 may not be adequate to justify simultaneously operating all of the EVS sensors 112, processing the image data, and rendering the captured images. Thus, as FIG. 2 further depicts, the processor 104 may also implement a sensor selection algorithm (206). The sensor selection algorithm (206) may rely solely upon the range and position information derived from the received ADS-B traffic data, or it may additionally rely on the results of the above-described threat assessment prioritization algorithm (205). The sensor selection algorithm (206) may additionally rely on the weather data supplied from the weather data source 114. In the preferred embodiment, the sensor selection algorithm (206) uses the range and position information from the ADS-B traffic data, the results of the threat prioritization algorithm (205), and the weather data from the weather data source 114 to select the appropriate EVS image sensor(s) 112. For this embodiment, the range to the farthest high priority level traffic entity determines the needed visibility range of the EVS image sensor 112. This determination, together with the supplied weather data and EVS image sensor characteristics, is used to select the EVS sensor 112 to be used for image capture.

Figure 3:
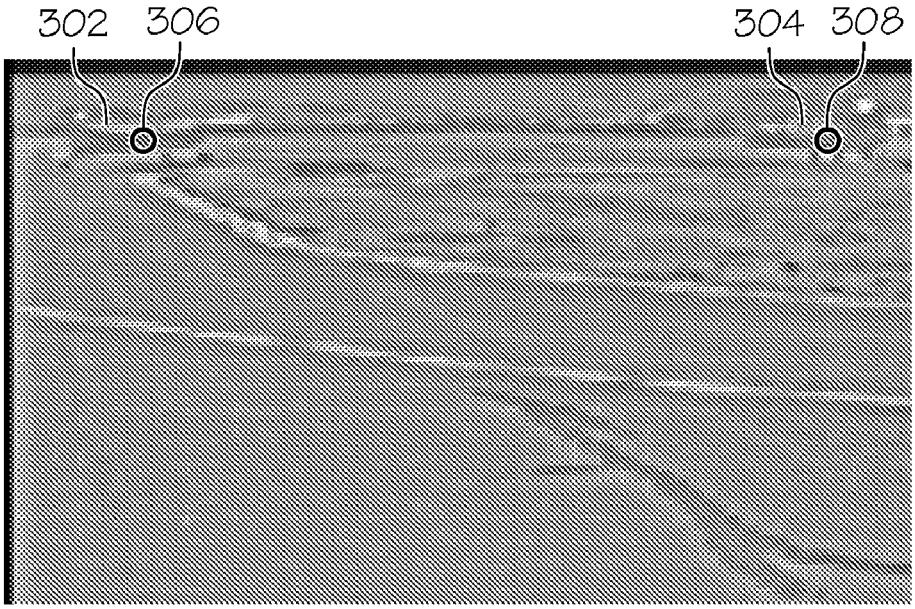
FIG. 3 is a photograph of an image that may be captured and processed by the system of FIG. 1 while implementing the exemplary process of FIG. 2.

After the appropriate EVS image sensor 112 is selected, the EVS image sensor 112 supplies image data representative of the high priority level traffic entities to the processor 104. An exemplary image that may be captured by the EVS sensor 112 is depicted in FIG. 3. In the depicted example, the aircraft is on an airport taxiway with two high priority traffic entities 302 and 304 ahead of it on the taxiway. As was noted above, the processor 104, upon receipt of image data from the EVS sensor 112, maps the position of each traffic entity in the captured image to corresponding image coordinates on EVS display 102 (206). In some embodiments, as FIG. 3 further depicts, the center-of-gravity (CG) 306, 308 of each high priority target entity 302, 304 may be marked on the captured image at the corresponding image coordinates.

Figure 4:
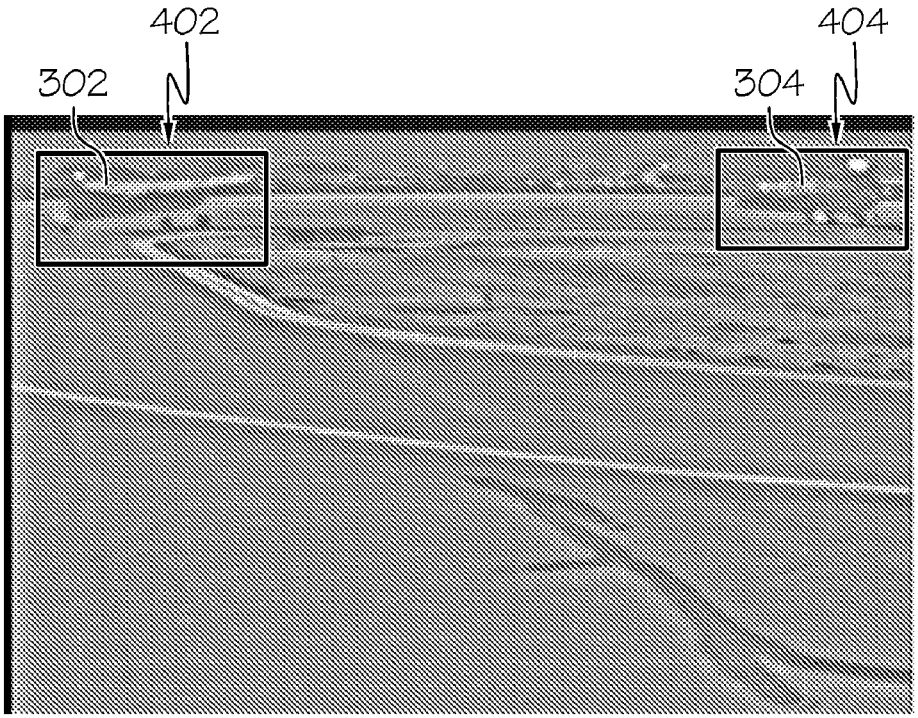
FIG. 4 is a photograph of a preliminary, but non-displayed, image that may be processed by the system of FIG. 1 while implementing the exemplary process of FIG. 2.

Thereafter, and as was also noted above, the processor 104 selects a region of interest around at least a portion of the corresponding image coordinates (212). In a preferred embodiment, and as is depicted most clearly in FIG. 4, the processor 104 selects a region of interest 402, 404 around each target 302, 304. In addition, the processor 104 preferably further processes the image within each region of interest 402, 404 to provide added clarity (213). In particular, the processor 104 preferably implements suitable noise filtering and contrast enhancement within each region of interest 402, 404.

Figure 5:
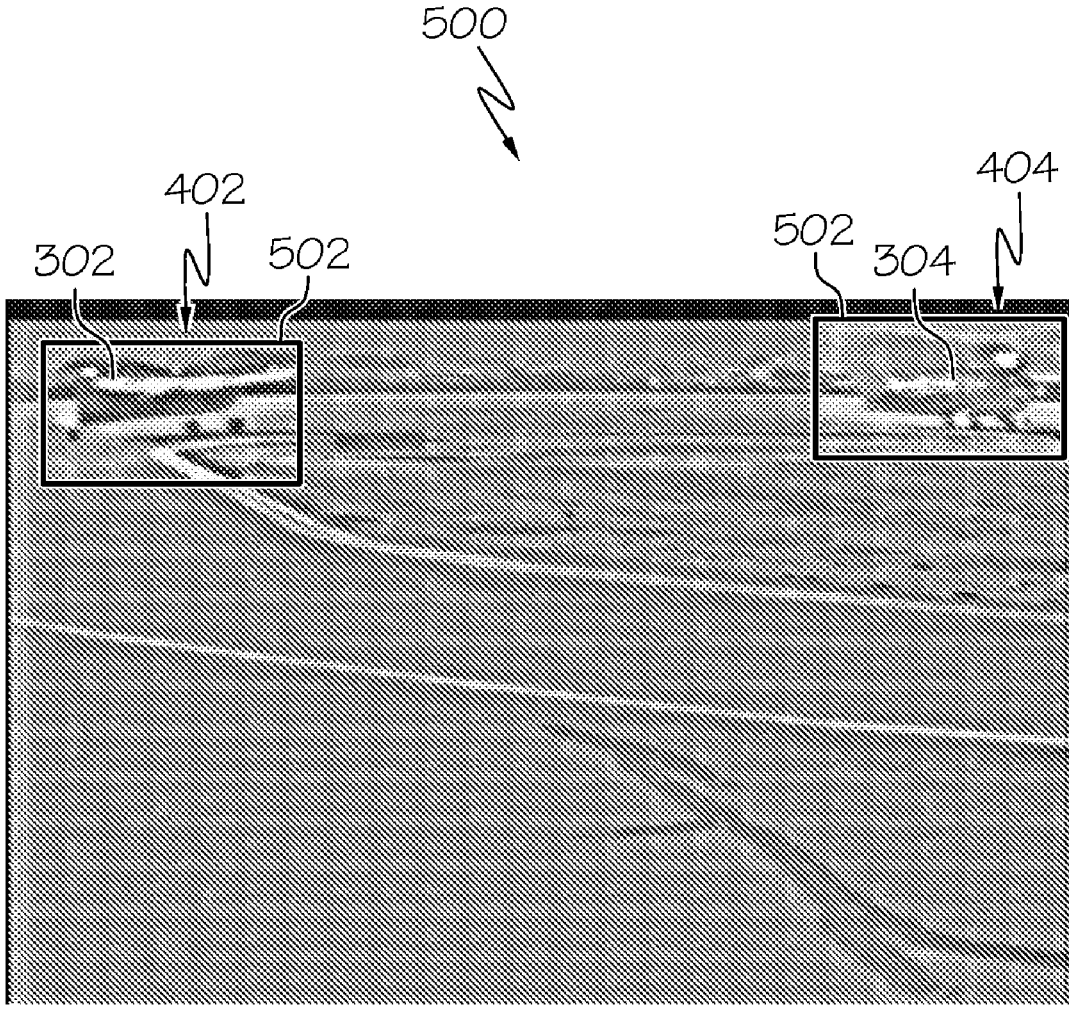
FIG. 5 is a photograph of an exemplary image that is displayed by the system of FIG. 1 while implementing the exemplary process of FIG. 2.

With reference now to FIG. 5, the exemplary image captured in FIG. 3 is depicted after each of the regions of interest 402, 504 is selected and the images within the regions of interest 402, 404 have been further processed. This is the image that is rendered on the EVS display 112, in response to the image rendering display commands supplied from the processor 104. It is seen that the rendered image 500 includes actual, enhanced images of each traffic entity 302, 304, at the corresponding image coordinates, and with a geometric shape, such as the depicted rectangle 502, surrounding and thereby highlighting each region of interest 402, 404.

A single system 100 is depicted in FIG. 1 and described above. It will be appreciated, however, that it may be viable to include multiple systems and/or EVS displays on a single aircraft platform. For example, one system 100 or EVS display 102 may be provided for each side of the aircraft. Including two or more systems 100 and/or EVS displays 102 on a single platform may provide a 360° comprehensive view of the surrounding environment, and thus further enhance the situational awareness. When multiple systems 100 or EVS displays 102 are included, a method to optimize individual EVS unit operation is also implemented. For example, depending on the location of traffic entities (as indicated by ADS-B data) and their priority (as decided by the threat assessment and prioritization algorithm), appropriate EVS display(s) 102 will be operated. Further, as discussed earlier, regions around the traffic entity(ies) in the captured image are highlighted for visual distinction. Such an optimized solution not only reduces computational requirement but also the pilot workload.

In addition to the above-described functionality, visual cues can be further analyzed using advanced image processing techniques to extract additional features. For example, the images captured by individual EVS image sensors 112 may be "mosaiced" or "stitched" to provide a more comprehensive, seamless view to the pilot. This seamless view may be most important to a pilot undergoing a curved approach (on single runway or parallel runways), during which the pilot may have a limited view of the runway, terrain, traffic. Moreover, the captured images may be subjected to advanced video analytics, such as object tracking.

Although the system 100 and method 200 were described herein as being implemented in the context of an aircraft, it may also be implemented in the context of an air traffic control station. Furthermore, during aircraft ground operations, the visual cues of surrounding aircraft may be up-linked from an aircraft to air traffic control using a suitable data link (e.g., WiMax) to improve an air traffic controller's situational awareness of ground traffic.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A method of providing enhanced situational awareness to an operator, comprising the steps of:

receiving automatic dependent surveillance-broadcast (ADS-B) traffic data transmitted by a traffic entity;

processing the ADS-B traffic data to determine traffic entity position;

mapping the traffic entity position to corresponding image coordinates on an enhanced vision system (EVS) display;

selecting a region of interest around at least a portion of the corresponding image coordinates; and rendering an actual image of the traffic entity on the EVS display, at the corresponding image coordinates, and with at least a portion of the region of interest being highlighted.

2. The method of claim 1, further comprising:

receiving ADS-B traffic data transmitted by a plurality of traffic entities;

computing a threat level of each of the traffic entities; and assigning a priority level to each of the traffic entities based on the computed threat levels.

3. The method of claim 2, further comprising:

selecting an EVS sensor from a plurality of sensors based at least in part on the priority level of each of the traffic entities.

4. The method of claim 3, further comprising:

determining a range to each of the traffic entities; and assigning a high priority level to traffic threats within a predetermined range.

5. The method of claim 4, further comprising:

rendering actual images on the EVS display of only those traffic entities that are assigned a high priority level.

6. The method of claim 4, further comprising:

receiving weather data representative of environmental weather conditions; and selecting an EVS sensor from a plurality of sensors based additionally on the received weather data.

7. The method of claim 1, further comprising:

enhancing at least the actual image of the traffic entity on the EVS display.

8. The method of claim 7, wherein the step of enhancing at least the actual image of the traffic entity includes:

noise filtering the actual image of traffic entity; and contrast enhancing the actual image of traffic entity.

9. The method of claim 1, further comprising:

rendering a geometric shape around the region of interest to thereby highlight the region of interest.

10. A system for providing enhanced situational awareness to an operator, comprising:

an enhanced vision system (EVS) display coupled to receive image rendering display commands and operable, in response thereto, to render images; and a processor in operable communication with the EVS display, the processor adapted to receive automatic dependent surveillance-broadcast (ADS-B) traffic data associated with a traffic entity and image data representative of the traffic entity and operable, in response to these data, to:

(i) determine traffic entity position, (ii) map the traffic entity position to corresponding image coordinates on the EVS display, (iii) select a region of interest around at least a portion of the corresponding image coordinates, and (iv) supply image rendering display commands to the EVS display that cause the EVS display to render an actual image of the traffic entity, at the corresponding image coordinates, and with at least a portion of the region of interest being highlighted.

11. The system of claim 10, wherein:

the processor is further adapted to receive ADS-B traffic data associated with a plurality of traffic entities; and the processor is further operable to (v) compute a threat level of each of the traffic entities and (vi) assign a priority level to each of the traffic entities based on the computed threat levels.

12. The system of claim 11, further comprising:

a plurality of EVS image sensors, each EVS image sensor operable to sense one or more target entities within a predetermined range and supply image data representative thereof, wherein the processor is further operable to select one of the plurality of EVS image sensors based at least in part on the priority level of each of the traffic entities.

13. The system of claim 12, wherein the processor is further operable to:

determine a range to each of the traffic entities; and assign a high priority level to traffic threats within a predetermined range.

14. The system of claim 13, wherein the processor is further operable to supply image rendering display commands to the EVS display that cause the EVS display to render actual images of only those traffic entities that are assigned a high priority level.

15. The system of claim 13, wherein the processor is further adapted to receive weather data representative of environmental weather conditions and is further operable to select one of the plurality of EVS sensors based additionally on the received weather data.

16. The system of claim 10, wherein the processor is further operable to:

implement a noise filter for the actual image of traffic entity; and implement contrast enhancing of actual image of traffic entity.

17. The system of claim 1, wherein the processor is further operable to supply image rendering display commands to the EVS display that cause the EVS display to render a geometric shape around the region of interest to thereby highlight the region of interest.

18. A system for providing enhanced situational awareness to an operator, comprising:

a plurality of enhanced vision system (EVS) image sensors, each EVS image sensor operable to sense one or more target entities within a predetermined range and supply image data representative thereof;

an EVS display coupled to receive image rendering display commands and operable, in response thereto, to render images; and a processor in operable communication with the EVS display, the processor adapted to receive automatic dependent surveillance-broadcast (ADS-B) traffic data associated with a traffic entity and image data from one or more of the EVS image sensors, the processor operable, in response to the received data, to:

(i) determine a position of each of the traffic entities, (ii) compute a threat level of each of the traffic entities, (iii) assign a priority level to each of the traffic entities based on the computed threat levels, (iv) select one of the plurality of EVS image sensors from which to receive image data based at least in part on the priority level of each of the traffic entities, (v) map each traffic entity position to corresponding image coordinates on the EVS display, (vi) select a region of interest around at least a portion of each of the corresponding image coordinates, and (vii) supply image rendering display commands to the EVS display that cause the EVS display to render actual images of selected ones of the traffic entities, at the corresponding image coordinates, and with at least a portion of each region of interest being highlighted.

19. The system of claim 18, wherein the processor is further operable to:

determine a range to each of the traffic entities; and assign a high priority level to traffic threats within a predetermined range.

20. The system of claim 19, wherein the processor is further operable to supply image rendering display commands to the EVS display that cause the EVS display to render actual images of only those traffic entities that are assigned a high priority level.

* * * * *